US008197219B2

(12) United States Patent
Garlow

(10) Patent No.: US 8,197,219 B2
(45) Date of Patent: Jun. 12, 2012

(54) ESTIMATION AND CONTROL OF A RESONANT PLANT PRONE TO STICK-SLIP BEHAVIOR

(75) Inventor: Mark E. Garlow, Kenosha, WI (US)

(73) Assignee: Unico, Inc., Franksville, WI (US)

( * ) Notice: Subject to any disclaimer, the term of this patent is extended or adjusted under 35 U.S.C. 154(b) by 202 days.

(21) Appl. No.: 12/629,645

(22) Filed: Dec. 2, 2009

(65) Prior Publication Data

US 2010/0076609 A1 Mar. 25, 2010

Related U.S. Application Data

(62) Division of application No. 11/564,474, filed on Nov. 29, 2006, now Pat. No. 7,645,124.

(60) Provisional application No. 60/740,377, filed on Nov. 29, 2005.

(51) Int. Cl.
*F04B 49/06* (2006.01)

(52) U.S. Cl. ..... 417/44.1; 700/89; 700/282

(58) Field of Classification Search ..... 417/44.1, 417/44.11, 42, 43, 53; 700/89, 282, 275; 166/357; 318/650
See application file for complete search history.

(56) References Cited

U.S. PATENT DOCUMENTS

| | | | | |
|---|---|---|---|---|
| 3,765,234 | A | 10/1973 | Sievert | |
| 4,878,206 | A | 10/1989 | Grosso et al. | |
| 5,039,280 | A | 8/1991 | Saulgeot et al. | |
| 5,281,100 | A | 1/1994 | Diederich | |
| 5,468,088 | A | 11/1995 | Shoemaker et al. | |
| 5,519,605 | A * | 5/1996 | Cawlfield | 700/31 |
| 5,663,929 | A | 9/1997 | Pavone et al. | |
| 5,820,350 | A * | 10/1998 | Mantey et al. | 417/45 |
| 5,842,149 | A * | 11/1998 | Harrell et al. | 702/9 |
| 6,021,377 | A * | 2/2000 | Dubinsky et al. | 702/9 |
| 6,233,524 | B1 * | 5/2001 | Harrell et al. | 702/9 |
| 6,370,459 | B1 * | 4/2002 | Phillips | 701/41 |
| 6,721,610 | B2 * | 4/2004 | Gade et al. | 700/52 |
| 6,890,156 | B2 * | 5/2005 | Watson et al. | 417/42 |
| 6,933,693 | B2 * | 8/2005 | Schuchmann | 318/432 |
| 7,172,037 | B2 * | 2/2007 | Dashevskiy et al. | 175/25 |
| 2004/0062657 | A1 * | 4/2004 | Beck et al. | 417/42 |
| 2004/0062658 | A1 * | 4/2004 | Beck et al. | 417/42 |
| 2004/0095028 | A1 * | 5/2004 | Shearer et al. | 310/12 |

OTHER PUBLICATIONS

Kno, BC. Chapter 3, The z-Transform. Digital Control Systems. 1980. pp. 78-82.

Perdikaris, GA. Chapter 3, Discrete Time Systems. Computer Controlled Systems Theory and Application. Microprocessor-Based Systems Engineering. Kluwer Academic Publishers, 1991. pp. 167-176.

* cited by examiner

*Primary Examiner* — Devon C Kramer
*Assistant Examiner* — Amene Bayou
(74) *Attorney, Agent, or Firm* — Reinhart Boerner Van Deuren S. C.

(57) ABSTRACT

An apparatus is provided for estimating and/or precluding stick-slip, or other oscillatory or resonant behavior, through use of a virtual transducer, which precludes the need for having sensors located adjacent to a driven element of the system, or adjacent contact surfaces at which the stick-slip relative motion may occur. Parameters measurable at a drive mechanism are utilized for controlling a system in a manner which precludes stick-slip, or other oscillatory or resonant behavior, of a driven element of the system. Relative motion between contacting surfaces in the driven element, prone to stick-slip behavior, is controlled after sufficient force is applied by the drive element to overcome static friction forces between the contacting surfaces and break them free from one another, relative motion between the surfaces is maintained at a high enough relative speed that the surfaces are precluded from contacting one another, so that stick-slip behavior is precluded.

8 Claims, 14 Drawing Sheets

ESTIMATION AND CONTROL OF A RESONANT PLANT PRONE TO STICK-SLIP BEHAVIOR

IDENTIFICATION OF RELATED APPLICATION

This patent application is a divisional of prior U.S. patent application Ser. No. 11/564,474 filed Nov. 29, 2006 now U.S. Pat. No. 7,645,124, which is claiming priority to U.S. Provisional Patent Application No. 60/740,377, filed Nov. 29, 2005, both of which are incorporated herein in their entirety by this reference.

FIELD OF THE INVENTION

This invention relates generally to estimation and control of resonant behavior in a system, and more particularly to estimation and control of resonant behavior in systems having two inertias coupled by a compliant connection, with such systems including those prone to exhibiting stick-slip behavior, such as systems and plants related to drilling for, and pumping oil.

BACKGROUND OF THE INVENTION

In general, any drive connection in a mechanical system exhibits some degree of compliance, i.e. a tendency to yield or bend under load, within the elastic limit of the material, or materials, of the components making up the connection. As a result of this compliance, a driving force exerted at one end of the connection causes the connection to stretch, bend, and/or twist, depending upon the nature of the connection, in such a manner that the driving force will be slightly out of phase with a corresponding reaction of a driven element at the opposite end of the connection, due to inertia of the driven component which must be overcome in order for the driving force to cause a motion of the driven element consistent with the motion of a driving element applying the driving force.

Under certain circumstances, depending upon construction of the system, compliance in the connection will cause an undesirable oscillating or resonant motion to be set up between the driving and driven elements.

Such oscillating behavior is sometimes observed in a system having an engine connected to an engine testing dynamo through a connection including an in-line torque sensor. Such torque sensors typically include a resilient element operatively joining an input element and an output element of the torque sensor. The resilient element allows the input and output elements to twist slightly, with respect to one another, in response to torque being transmitted through the torque sensor. This twisting can be measured and used to determine the torque being transmitted by the coupling.

During an increase and/or decrease in torque, however, the resilient element may cause the system to oscillate as energy is alternately stored and released in the resilient element, until equilibrium is achieved. Such oscillation can be damaging or otherwise detrimental to operation of the system and its components. It is desirable, therefore, to provide an apparatus and method for estimating such behavior, and for controlling the system in such a manner that the undesirable oscillatory or resonant behavior is precluded and/or held within acceptable bounds. It is also highly desirable, in some circumstances, to provide for such control without having sensors located at the driven element, i.e. at the dynamo in the example given above, in order to remove complexity and cost and to improve reliability of the system.

In some systems, oscillating or resonant behavior takes a form known as stick-slip behavior. Stick-slip behavior refers to an undesired intermittent form of motion that sometimes occurs between relatively moving parts where the coefficient of kinetic friction between the parts is less than the coefficient of static friction between the parts. Contacting surfaces of the parts will stick to one another until a driving force, being exerted on one of the parts by a drive element to cause relative movement between the parts, reaches a value high enough to overcome the static frictional force between the contact surfaces.

Due to the fact that the static coefficient of friction is higher than the kinetic coefficient of friction, once the static friction force is overcome by the driving force, the contact surfaces of the parts will tend to move freely and rapidly with respect to one another.

Because there is an inherent springiness (compliance) in the drive element applying force between the parts, the drive element will tend to stretch or compress, or wind up, as force is applied to the movable part while the contact surfaces are being held in contact by the static friction force. Once relative motion occurs, this compression, tension, or winding-up of the drive element will cause rapid movement between the parts, to release the energy stored in compression, tension or wind-up of the drive element. Once the stored energy is released, however, through rapid relative movement between the parts, the relative velocity between the contact surfaces will drop to the point that the static friction force will once again cause the parts to stick to one another, and thereby preclude further relative motion, until sufficient compression, tension, or wind-up of the drive element once again occurs, to overcome the static frictional force and cause slipping of the contact surfaces relative to one another.

Such stick-slip behavior is known to sometimes occur in metal working equipment, for example, where a drill bit or milling cutter must be driven by a power source located some distance from the point at which material removal is occurring, such that the drill bit or cutter must have a long shank, and/or be connected to a long drive shaft.

Stick-slip behavior is also sometimes encountered in machinery used in drilling for, or pumping fluids, such as gas, water, or oil, out of the ground. In such applications, long shafts, having lengths of hundreds or thousands of feet, may connect a drilling or pumping apparatus located far below ground level to a shaft drive mechanism located above ground level. Such long shafts have considerable inherent springiness, both axially and radially. This considerable springiness allows a significant amount of energy to be stored in the shaft, if the underground components stick to one another, such that when the torsional force due to wind-up of the shaft becomes high enough to cause the underground parts to break free from one another, they will slip relative to one another at a very high rotational speed, until the energy stored in the shaft is dissipated.

In addition to placing significant undesirable strain on the working components of the system, stick-slip operation of a pump also will substantially reduce the pumping capacity of the pump. While the parts are stuck to one another no relative motion or pumping is occurring, and during a portion of the stick-slip cycle in which the parts are moving very rapidly with respect to one another, pumping may also not be occurring.

Stick-slip operation, and its detrimental effects, is further discussed in a United States Patent Application No. US 2004/0062658 A1, published Apr. 1, 2004, to Beck, et al., assigned to the assignee of the present invention, the disclosure and teachings of which are incorporated herein in their entirety.

Prior approaches to dealing with a system exhibiting stick-slip behavior, have sometimes utilized sensors located adjacent to the contacting surfaces subject to stick-slip behavior. In oil pumping operations, for example, this has sometimes required placement of sensing equipment a mile or more below the earth's surface and making connections to a controller located above ground. Such sensors tend to be quite expensive to produce and maintain, and are prone to failure due to the hostile environment in which they are located. Should repair of the sensing elements be required, significant interruption to the pumping process is incurred, in pulling the sensing unit back up to the surface of the ground where it can be repaired and/or replaced.

It is highly desirable, therefore, to provide an improved method and/or apparatus for estimating and controlling undesirable oscillatory or resonant behavior in a system prone to such behavior, and particularly in systems which may be prone to stick-slip behavior. It is also desirable to provide an apparatus and/or method for controlling such systems with a minimal number of transducers, and preferably without the necessity for having such transducers located near a driven element of the system.

SUMMARY OF THE INVENTION

An improved method and apparatus for estimating precluding stick-slip, or other oscillatory behavior is provided. In some embodiments, estimating and precluding stick-slip, or other oscillatory behavior is accomplished with a "virtual transducer," without the need for having sensors located adjacent to a driven element, or adjacent to contact surfaces at which stick-slip relative motion may occur. As a result, significant advantage is provided in an oil pumping system, for example, by eliminating the undesirable cost and difficulty of locating sensors in a hostile environment far below the surface of the ground.

In one embodiment, stick-slip behavior, or other oscillatory behavior, of a system may be estimated and related to parameters measurable in a drive apparatus of the system. In an application such as, for example, an oil pumping system having a progressive cavity pump driven by an electric motor, parameters such as velocity, torque, rotational angle, and input power, all of which are measurable above ground at the drive apparatus, may be utilized in detecting and estimating stick-slip behavior.

In another embodiment, parameters measurable at a drive mechanism, such as the speed, torque, rotational angle, and power of an electric motor driving a driven element in a system susceptible to stick-slip behavior, may be utilized, in a "virtual transducer," for controlling the system in a manner which precludes stick-slip, or other oscillatory or resonant, behavior of the driven element. In some embodiments, prone to stick-slip behavior, relative motion between contacting surfaces in the driven element is controlled in such a manner that, after sufficient force is applied to overcome the static friction force between the contacting surfaces and break them free from one another, relative motion between the surfaces is controlled at a high enough relative speed that the surfaces are precluded from contacting one another, so that stick-slip behavior is precluded.

One embodiment provides a "virtual transducer," for use in controlling a system prone to stick-slip, or other oscillatory or resonant, behavior, thereby precluding the need for providing one or more of the sensors which had to be located adjacent the driven element in prior approaches to controlling such systems.

Other aspects, objects and advantages will become apparent from the following brief description of drawings and attachments, and the detailed descriptions provided within the attachments.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE EXEMPLARY EMBODIMENTS

Figure 1:
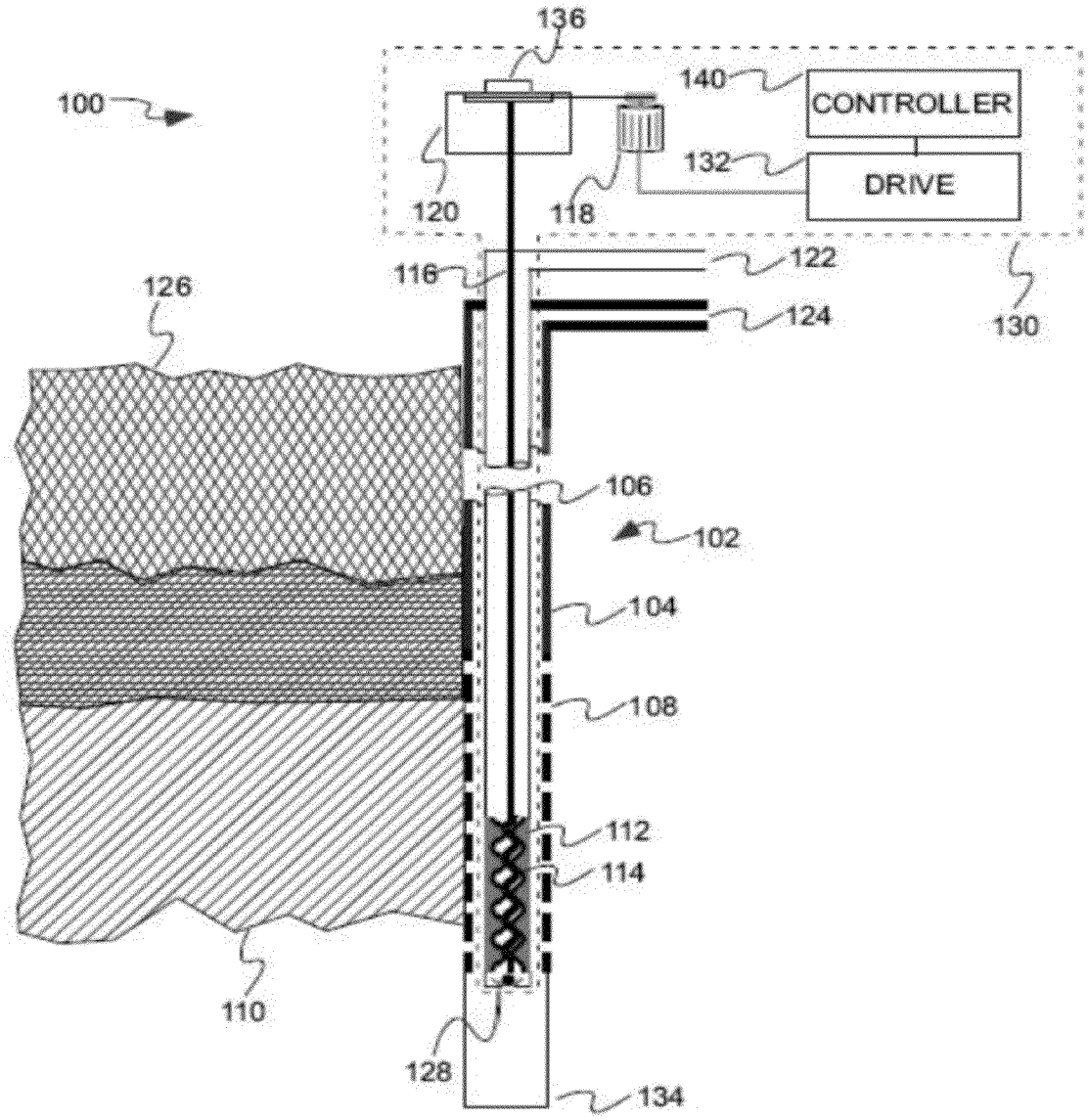
FIG. 1 is an illustration of an exemplary environment in which the finite difference state estimator may operate.

Referring to FIG. 1, an exemplary environment 100 in which the present invention may operate shall be described with reference to an oil well 102 wherein oil is to be separated from an underground gas formation 110. The well 102 includes an outer casing 104 and an inner tube 106 that extend from ground level to as much as 1000 feet or more below ground level. The casing 104 has perforations 108 to allow the fluid in the underground formation to enter the well bore. It is to be understood that water and gas can be combined with oil and the pump can be used for other liquids. The control apparatus described herein can also be used for water only. The bottom of the tube generally terminates below the underground formations.

A progressing cavity pump (PCP) 112 is mounted at the lower end of the tube 106 and includes a helix type of pump member 114 mounted inside a pump housing. The pump member is attached to and driven by a pump rod string 116 which extends upwardly through the tube and is rotated by a drive motor 118 in a conventional well head assembly 120 above ground level. The tube 106 has a liquid outlet 122 and the casing 104 has a gas outlet 124 at the upper end above ground level 126. These elements are shown schematically in FIG. 1. The construction and operation of the progressing cavity pump is conventional. An optional check valve 128 may be located either on the suction side or the discharge side of the pump 112 to reduce back flow of fluid when the pump is off.

The operation of the pump 112 is controlled by a pump control system and method including a stick-slip estimator and controller in accordance with the present invention. For purposes of illustration, the pump control system 130 is described with reference to an application in a pump system that includes a conventional progressing cavity pump. The progressing cavity pump includes an electric drive system 132 and motor 118 that rotates the rod string 116 that includes helix portion 114 of the pump 112. The rod string 116 is suspended from the well head assembly 120 for rotating the helix 114 that is disposed near the bottom 134 of the well.

The rod string 116 is driven by an electric motor 118, the shaft of which can be coupled to the rod string through a gearbox 136 or similar speed reduction mechanism. The motor 118 can be a three-phase AC induction motor designed to be operated from line voltages in the range of 230 VAC to 690 VAC and developing 5 to 250 horsepower, depending upon the capacity and depth of the pump. The gearbox 136 converts motor torque and speed input to a suitable torque and speed output for driving the rod string 116 and helix 114 carried thereby.

Figure 2:
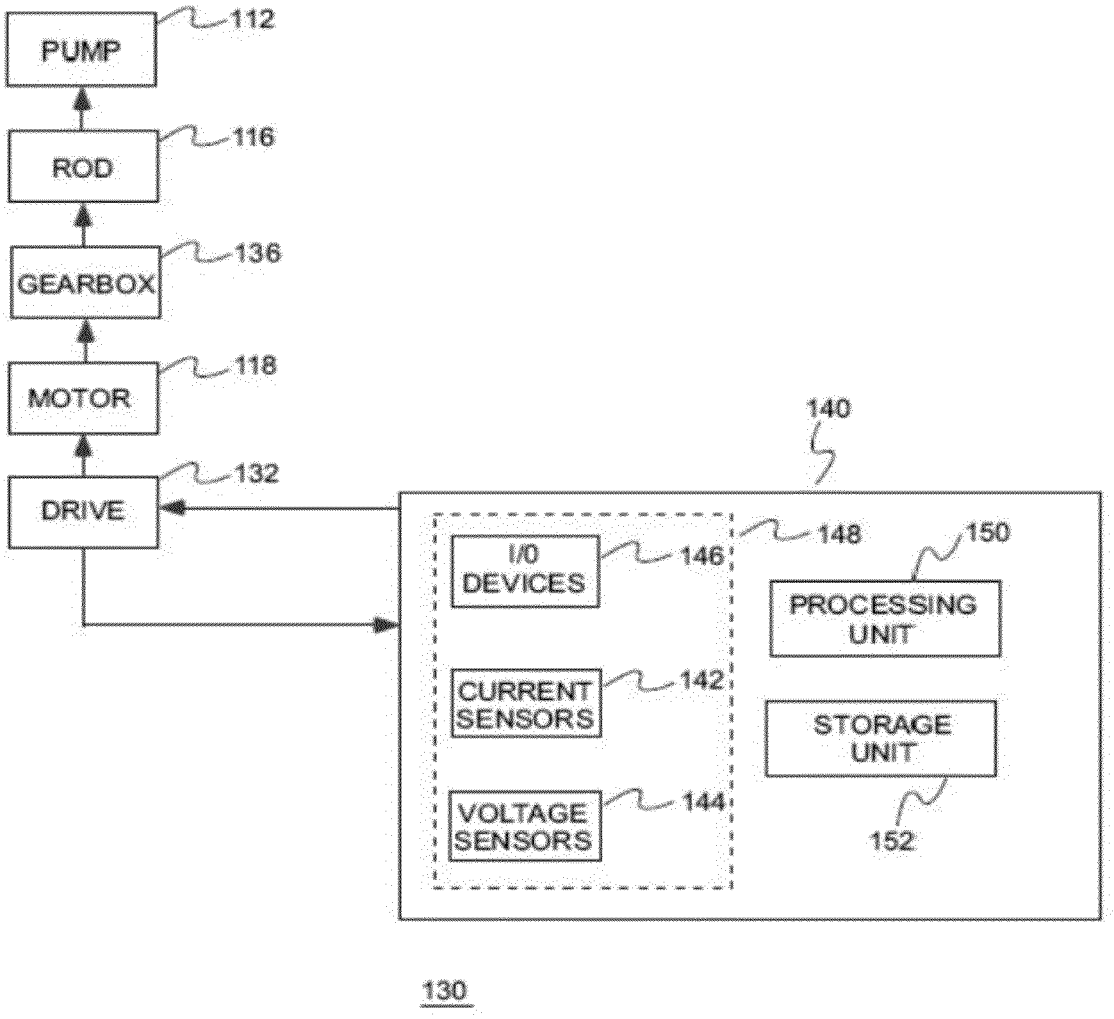
FIG. 2 is a block diagram of an exemplary control system of FIG. 1 in which the finite difference state estimator may implemented.

Turning now to FIG. 2, there is shown a simplified representation of the pump control system 130 for the pump 112 in which the stick-slip estimator/control may be implemented. It is to be understood that the estimator and control may be implemented into other control systems or as a separate component. The pump control system 130 controls the operation of the pump 112. The pump control system 130 includes transducers, such as motor current and motor voltage sensors, to sense dynamic variables associated with motor torque and velocity. The pump control system further includes a controller 140, a block diagram of which is shown in FIG. 2. Current sensors 142 of interface devices 148 are coupled to a sufficient number of the motor windings—two in the case of a three phase AC motor. Voltage sensors 144 are connected across the motor winding inputs. The motor current and voltage signals produced by the sensors 142 and 144 are supplied to a processing unit 150 of the controller 140 through suitable input/output devices 146. The controller 140 further includes a storage unit 152 including storage devices which store programs and data files used in calculating operating parameters and producing control signals for controlling the operation of the pump system. The storage unit 152 has memory that may be volatile (such as RAM), non-volatile (such as ROM, flash memory, etc.) or some combination of the two. Additionally, the storage unit 152 may also have additional features/functionality. For example, the storage unit 152 may also include additional storage (removable and/or non-removable) including, but not limited to, magnetic or optical disks or tapes. Computer storage media includes volatile and nonvolatile, removable and non-removable media implemented in any method or technology for storage of information such as computer readable instructions, data structures, program modules or other data. The memory, the removable storage and the non-removable storage are all examples of computer storage media. Computer storage media includes, but is not limited to, RAM, ROM, EEPROM, flash memory or other memory technology, CD-ROM, digital versatile disks (DVD) or other optical storage, magnetic cassettes, magnetic tape, magnetic disk storage or other magnetic storage devices, or any other medium which can be used to store the desired information and which can accessed by the controller 140.

Although not required, the stick slip estimator/controller will be described in the general context of computer-executable instructions, such as program modules, being executed by the processing unit 150. Generally, program modules include routines, programs, objects, components, data structures, etc. that perform particular tasks or implement particular abstract data types. Moreover, those skilled in the art will appreciate that the invention may be practiced in distributed computing environments where tasks are performed by remote processing devices that are linked through a communications network. In a distributed computing environment, program modules may be located in both local and remote memory storage devices.

The self-sensing control arrangement described above provides nearly instantaneous estimates of motor velocity, crank angle, and torque, which can be used for both monitoring and real-time, closed-loop control of the pump, including the stick-slip behavior. Voltages and currents are sensed to determine the instantaneous electric power drawn from the power source by the electric motor operating the pump and the crank angle of the motor 118. As the rod 116 (FIG. 1) that drives the progressing cavity pump 112 is rotated, the motor 118 is loaded. By monitoring the motor current and voltage, the parameters for the stick-slip estimator/control can be calculated. More specifically, interface devices 148 (FIG. 2) contain the devices for interfacing the controller 140 with the outside world. Sensors in blocks 142 and 144 can include hardware circuits which convert and calibrate the motor current and voltage signals into current and flux signals. After scaling and translation, the outputs of the voltage and current sensors can be digitized by analog to digital converters in block 148. The processing unit 150 combines the scaled signals with motor equivalent circuit parameters stored in the storage unit 152 to produce a calculation of electrical torque, crank angle, and crank velocity. In one embodiment, values of parameters are derived using measured values of instantaneous motor currents and voltages, together with pump and system parameters, without requiring down hole sensors, flow sensors, etc.

Figure 3:
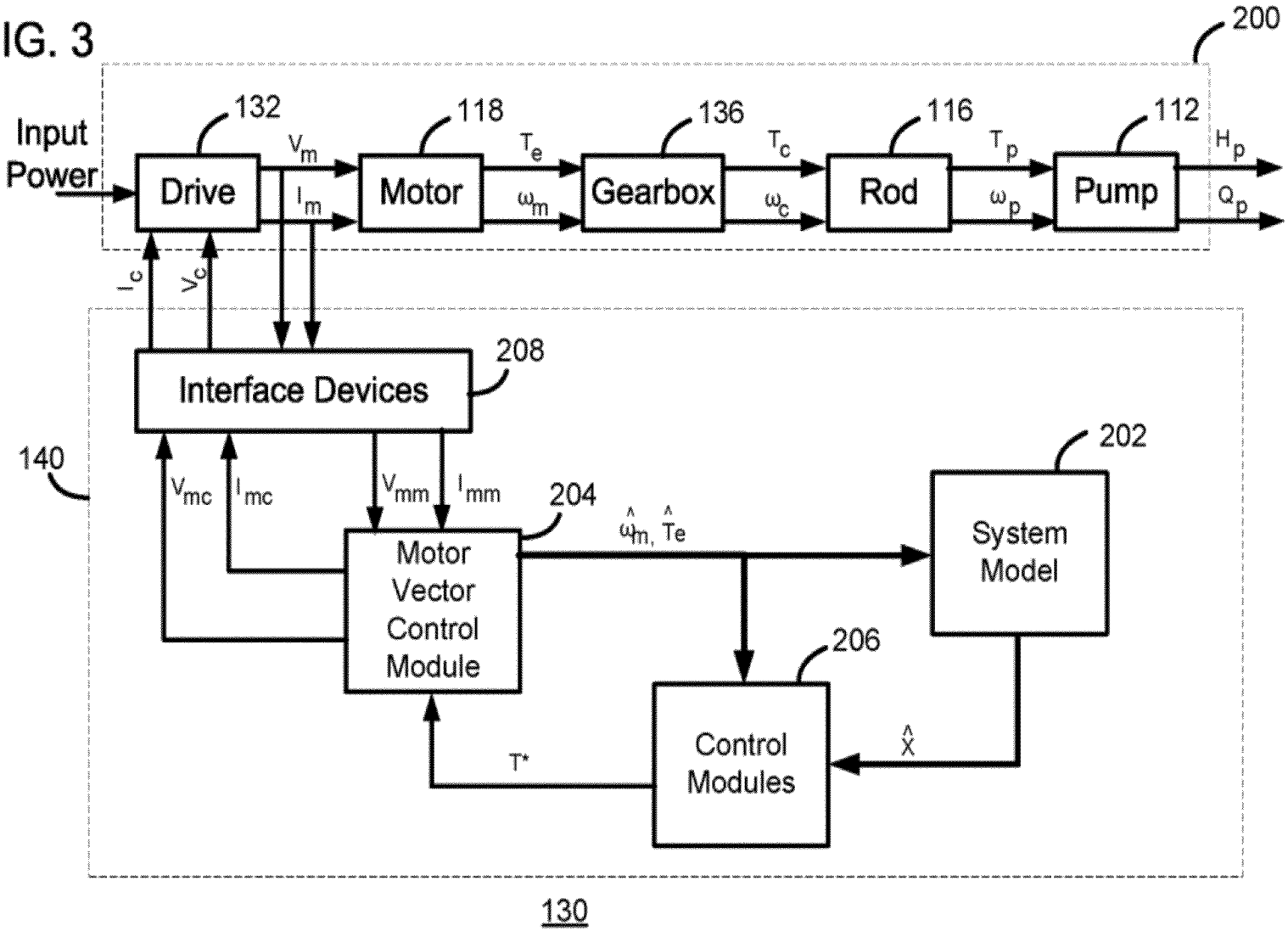
FIG. 3 is a block diagram of an exemplary controller in which the finite difference state estimator may be implemented.

Turning now to FIG. 3, which is a functional block diagram of the pump control system 130, as previously described, the pump 112 is driven by a drive 132, motor 118 and gearbox 136 to transfer fluid within a system 200. The pump 112 is coupled to the output of the drive motor 118 through a gearbox 136 (e.g., gear reducer) and accordingly, the pump speed Up is equal to Um divided by Ng, where Um is the motor speed and Ng is the gearbox ratio. The pump torque Tp is equal to Tm multiplied by the product of Ng and Eg, where Tm is the motor torque and Eg is the gearing efficiency. The operation of the motor 118 is controlled by the drive 132 and controller 140 which includes a system model 202, motor vector controller 204, other controllers 206, and interface devices 208. The output of the gearbox is referred to as a crank in the exemplary embodiment shown in FIG. 1 and it drives a long metal rod Motor vector controller 204 generates motor current commands Imc and voltage commands Vmc based upon signals from control modules 206. Control modules 206 receives estimates of system parameters from system model 202 and may have, for example, a fluid level feedforward control module that outputs a motor torque feedforward signal and a fluid level feedback control module that outputs a motor speed command. The motor speed command and the motor torque feedforward signal can then be combined to generate motor current commands Imc and voltage commands Vmc. Interface devices in block 208, which can be digital to analog converters, convert the current commands Imc and voltage commands Vmc into signals which can be understood by the drive 132. These signals are shown as Ic for motor current commands and Vc for motor winding voltage commands.

Figure 4:
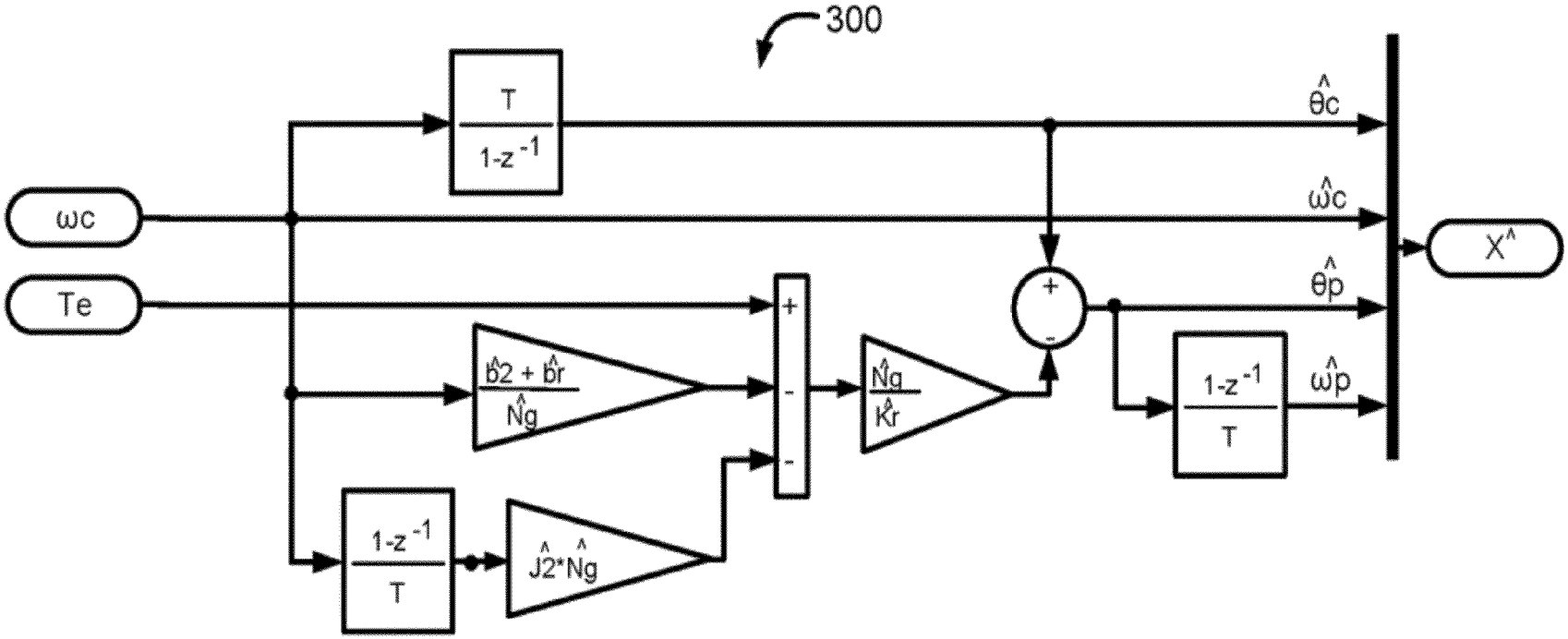
FIG. 4 is a block diagram of an exemplary embodiment of a finite difference state estimator.

Turning now to FIG. 4, the system model 202 uses a finite difference state estimator 300 to estimate the un-measurable states in the pump 112. In the embodiment shown in FIG. 4, the un-measurable states are the pump angle and pump speed. In FIG. 4, b2 is an estimate of the drive damping, b is an estimate of the pump damping, Ng is an estimate of the gear reduction ratio, Kr is an estimate of the rod spring stiffness constant, J2 is an estimate of pump inertia, Ac is the crank angle, We is the crank speed, Te is the electrical torque, Ap is the estimated pump angle, and Wp is the estimated pump speed. These estimates can be based upon a user's intuition based on past experience and manufacturer's ratings of the components in the system. The estimated angle is derived from the calculation:

$$Ap(z) = Ac(z) - \frac{Ng}{Kr}\left(T_e(z) - \frac{b2+b}{Ng} * Wc(z) - \left(\frac{J2}{Ng * T}\right) * (Wc(z) - Wc(z-1))\right)$$

where T is the sampling period. The estimated speed is derived from the calculation $$Wp = \frac{1}{T}(Ap(z) - Ap(z-1))$$

where T is the sampling period. Additionally, the crank acceleration (Alphac) is derived by differentiating the crank speed Wc:

$$Alphac = \frac{1}{T}(Wc(z) - Wc(z-1))$$

Note that the Te(z) and Wc(z) inputs were passed through low pass filters prior to the above calculations. For best performance, the low pass filters on the Wc and Te inputs should have the same frequency response and delay as each other.

Figure 5:
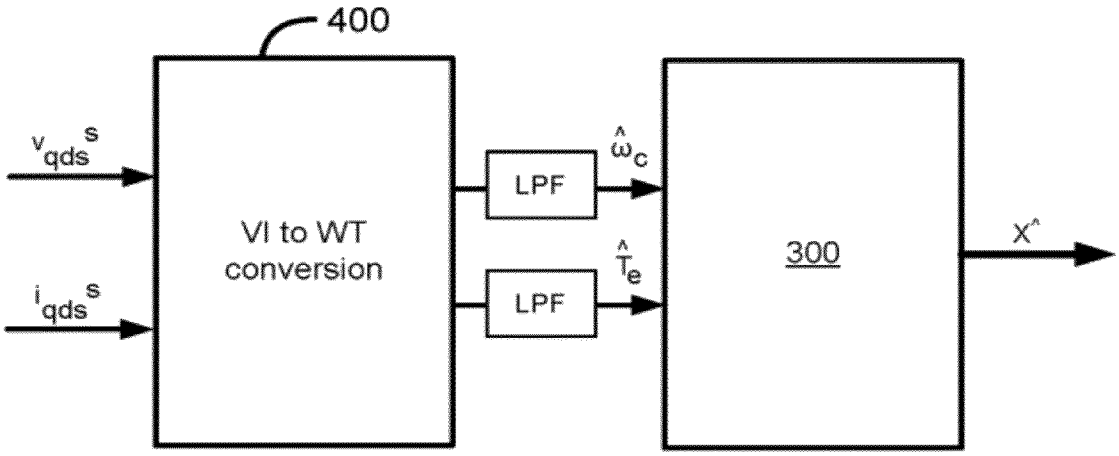
FIG. 5 is a block diagram illustration of a system in which the inputs to the finite difference state estimator are derived based upon voltage and current measurements.

In the embodiment shown in FIG. 4, Ac, Wc, and Te are measurable. In some applications, only voltage and current is known. In such applications, Ac, Wc, and Te have to be estimated. Turning now to FIG. 5, in an embodiment, the Ac, Wc, and Te parameters are estimated based upon voltage and current measurements. At block 400, the Ac, Wc, and Te are estimated based upon the calculations:

$$\lambda^s_{qds} = \int (V^s_{qds} - i^s_{qds}\hat{R}_s \cong \frac{1}{s+b}(V^s_{qds} - i^s_{qds}\hat{R}_s)$$

$$\lambda^s_{qdr} = \frac{\hat{L}_r}{\hat{L}_m}(\lambda^s_{qds} - \hat{\sigma}_{LS} i^s_{qds})$$

$$\hat{T}_e = \frac{3}{2}P_p(\lambda^{\wedge s}_{ds} i^{\wedge s}_{qs} - \lambda^{\wedge s}_{qs} i^{\wedge s}_{ds})$$

$$\hat{w}_e = \frac{P\lambda^{\wedge s}_{ds} i^{\wedge s}_{qs} - P\lambda^{\wedge s}_{qs} i^{\wedge s}_{ds}}{\lambda^{\wedge s^2}_{qs} + \lambda^{\wedge s^2}_{ds}}$$

where P is a derivative operator $$\hat{w}_s = \frac{\hat{L}_m}{\hat{T}_r}\left(\frac{\lambda^{\wedge s}_{dr} i^{\wedge s}_{qs} - \lambda^{\wedge s}_{qs} i^{\wedge s}_{ds}}{\lambda^{\wedge s^2}_{qr} + \lambda^{\wedge s^2}_{dr}}\right)$$

$$\hat{w}_r = \frac{1}{P_p}(\hat{w}_e - \hat{w}_s)$$

$$\hat{w}_c = \frac{\hat{w}_r}{\hat{N}g}$$

$$\hat{A}_c = \int \hat{w}_c$$

Figure 6:
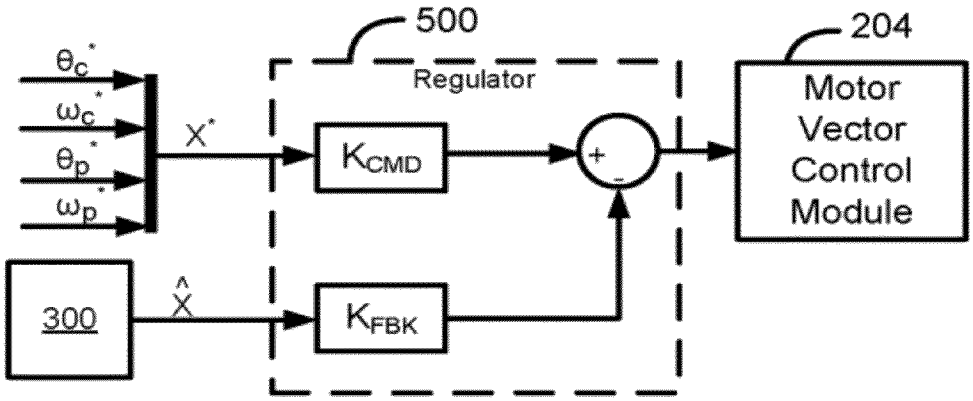
FIG. 6 is a block diagram illustration of the finite difference state estimator interfacing with a regulator structure.

In another embodiment, Te is estimated while Ac and Wc are measured with an encoder. Turning now to FIG. 6, one type of control module that can be used with the finite difference state estimator 300 is a regulator structure 500. One such regulator structure has a gain [k1; k2; k3; k4] that corresponds to the gain for the errors of the reference vector x*=[Ac*, Wc*, Ap*, Wp*] minus the four system states $\hat{x}=[\hat{A}_c, \hat{W}_c, \hat{A}_p, \hat{W}_p]$.

Figure 7:
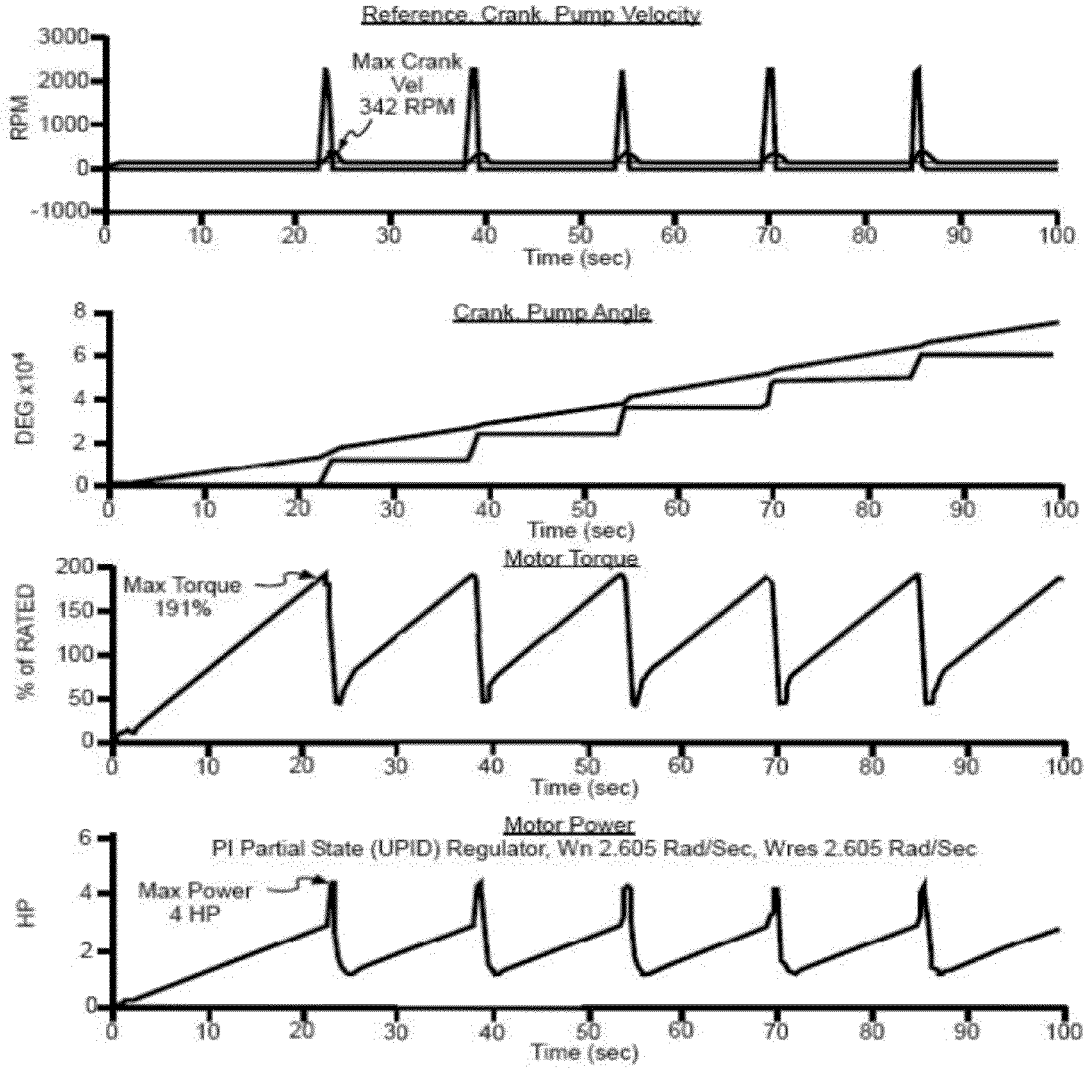
FIG. 7 is a series of graphs illustrating that a conventional PI (proportional integral) surface speed regulator does not handle a stick-slip load.
Figure 8:
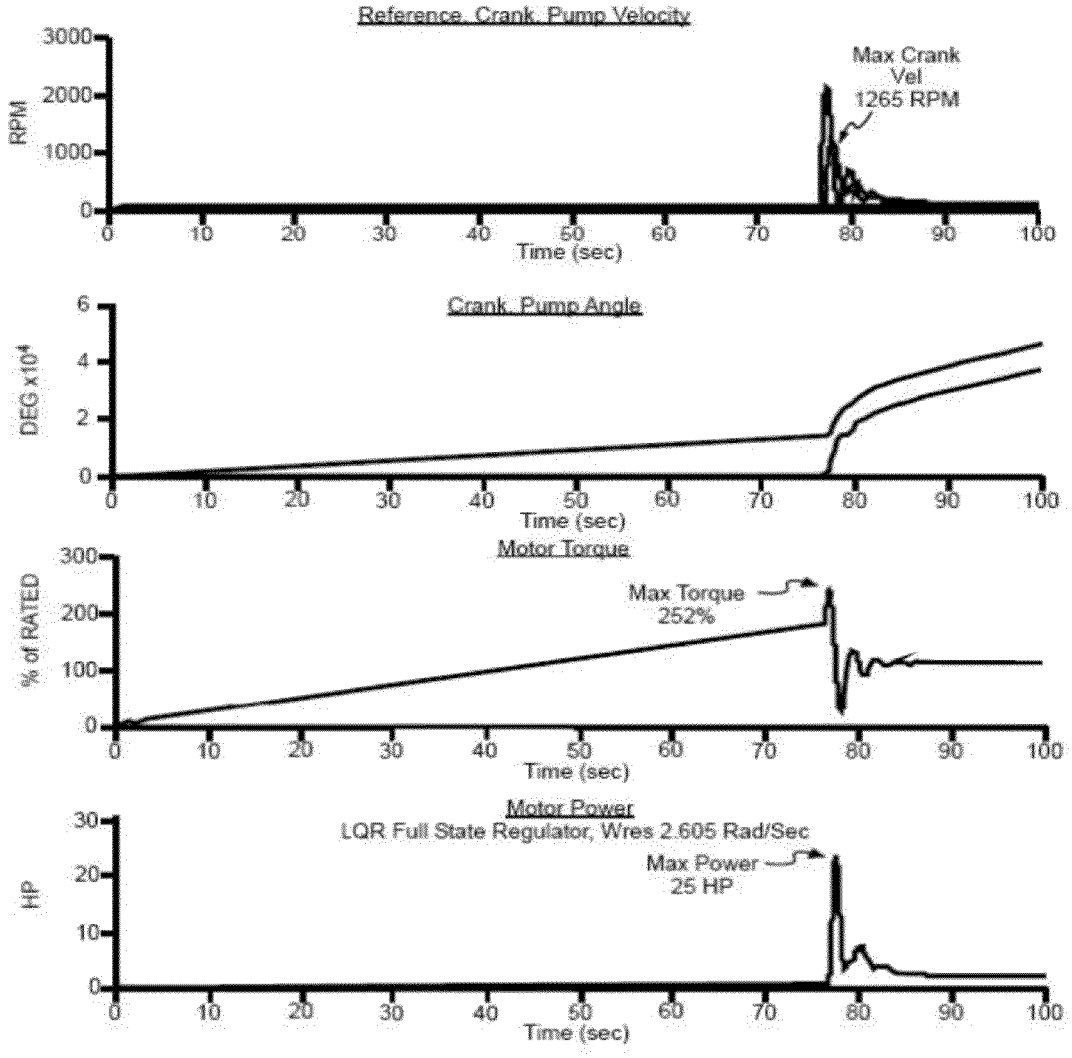
FIG. 8 is a series of graphs illustrating that a linear quadratic regulator handles the stick-slip condition.
Figure 9:
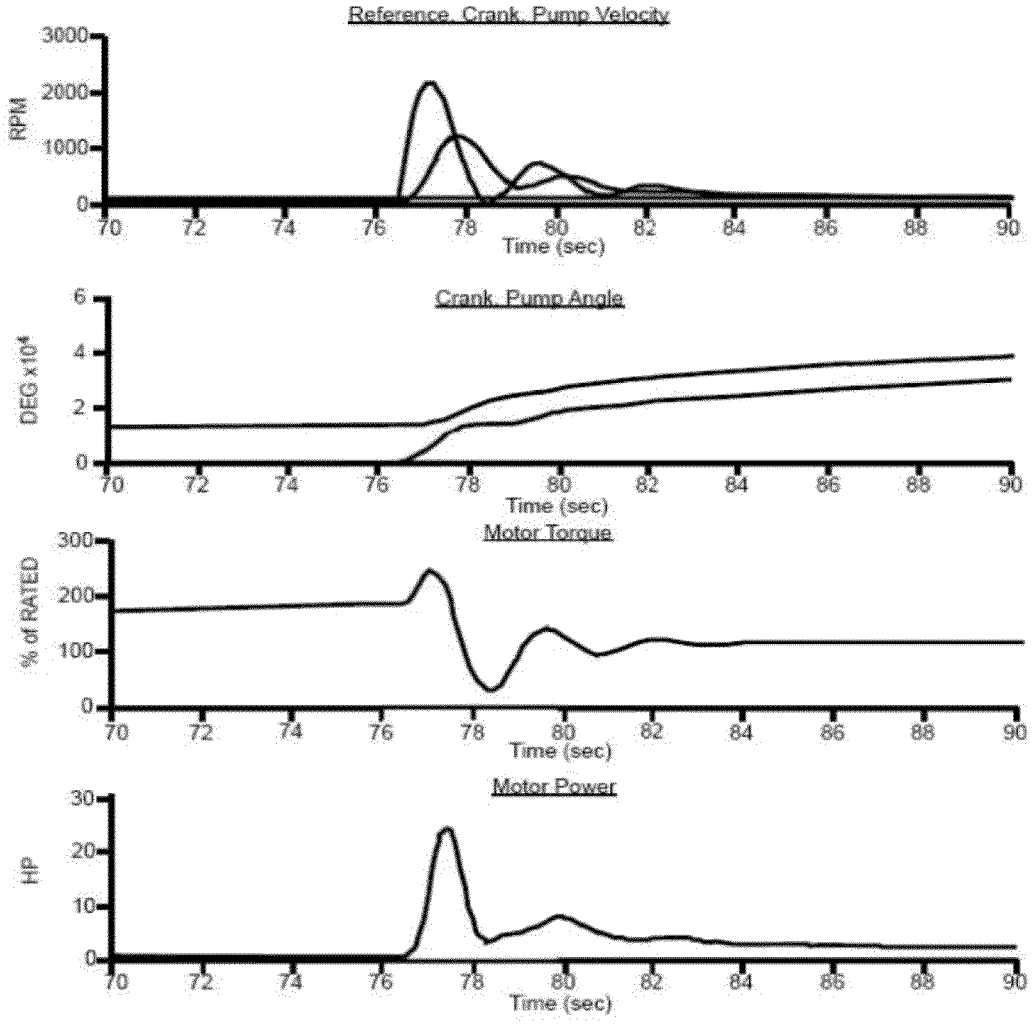
FIG. 9 is a series of graphs of FIG. 8 with the time scale expanded.
Figure 10:
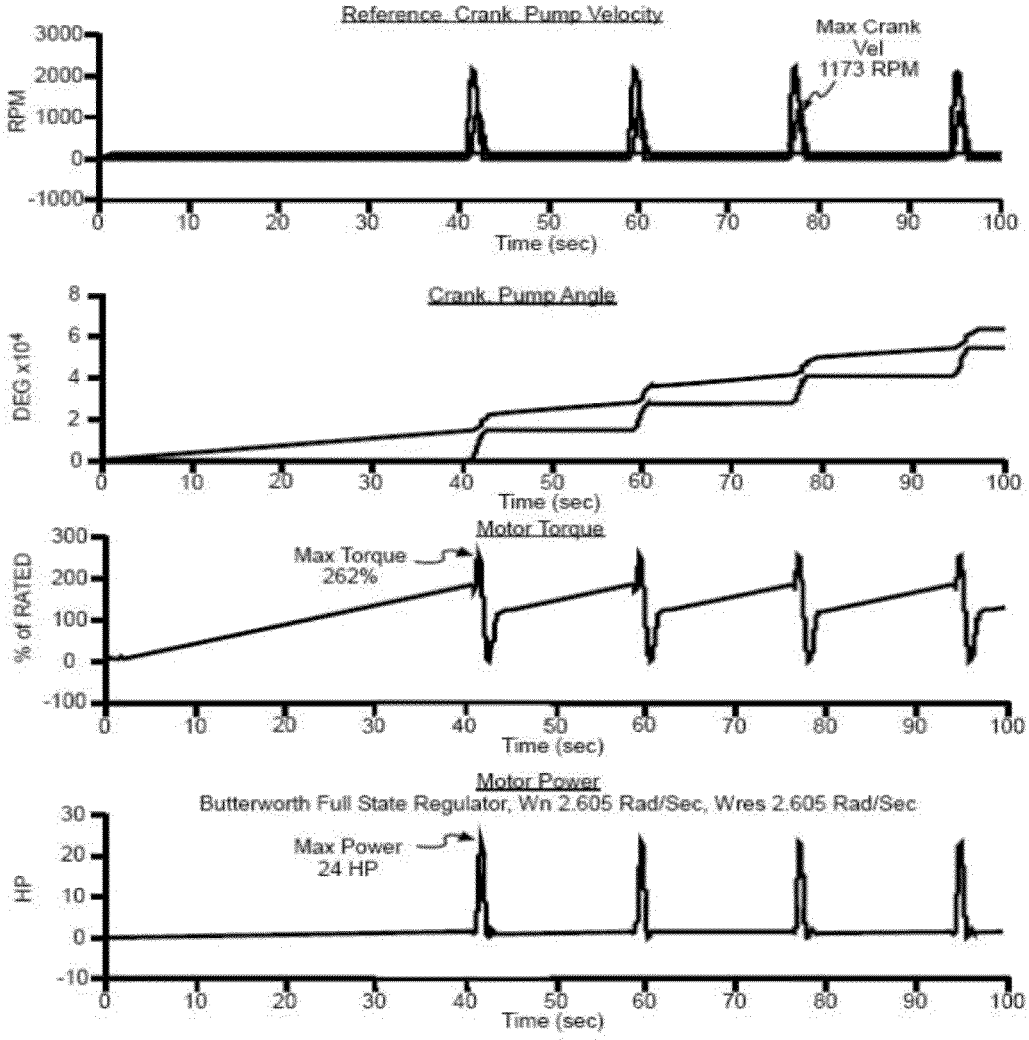
FIG. 10 is a series of graphs illustrating that a Butterworth full state feedback regulator does not handle stick-slip.
Figure 11:
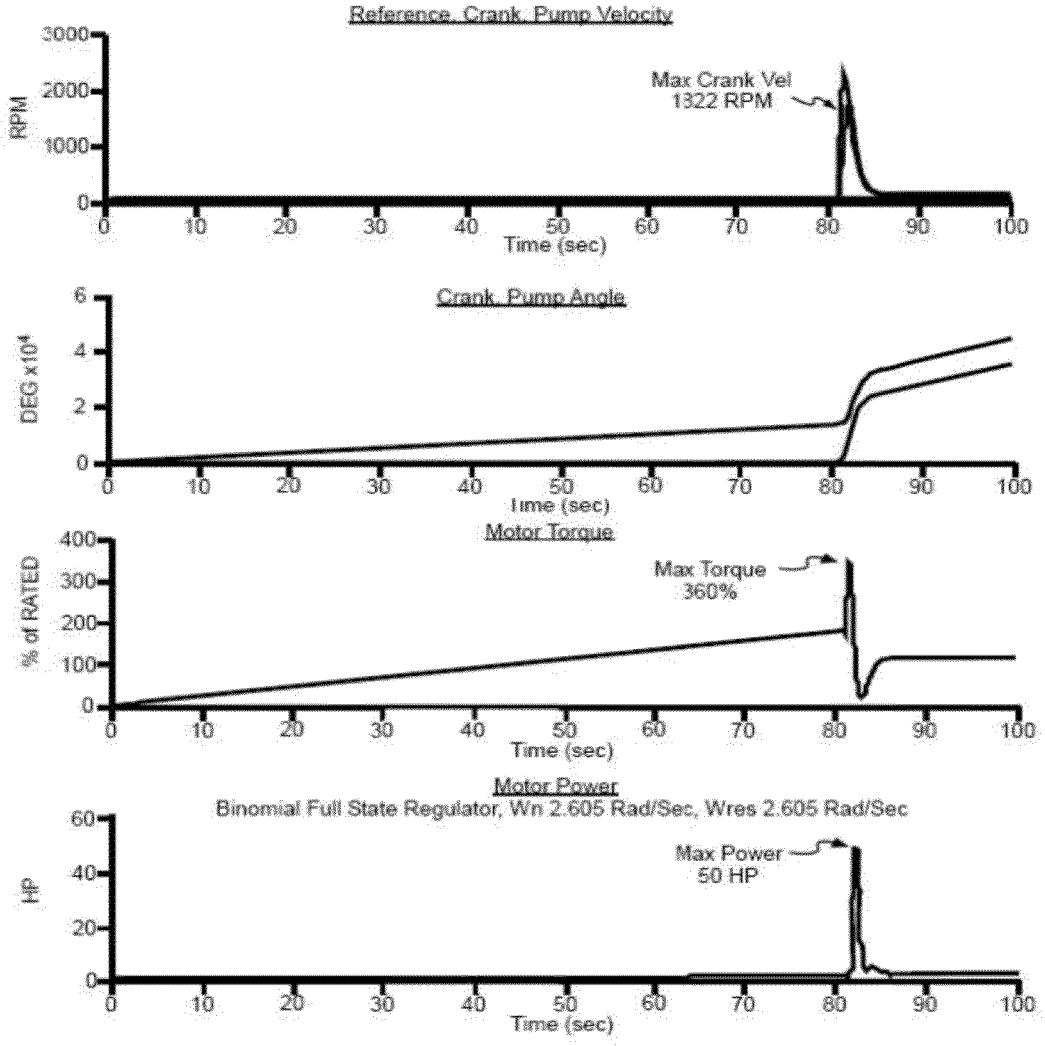
FIG. 11 is a series of graphs illustrating that a binomial full state feedback regulator handles stick-slip.
Figure 12:
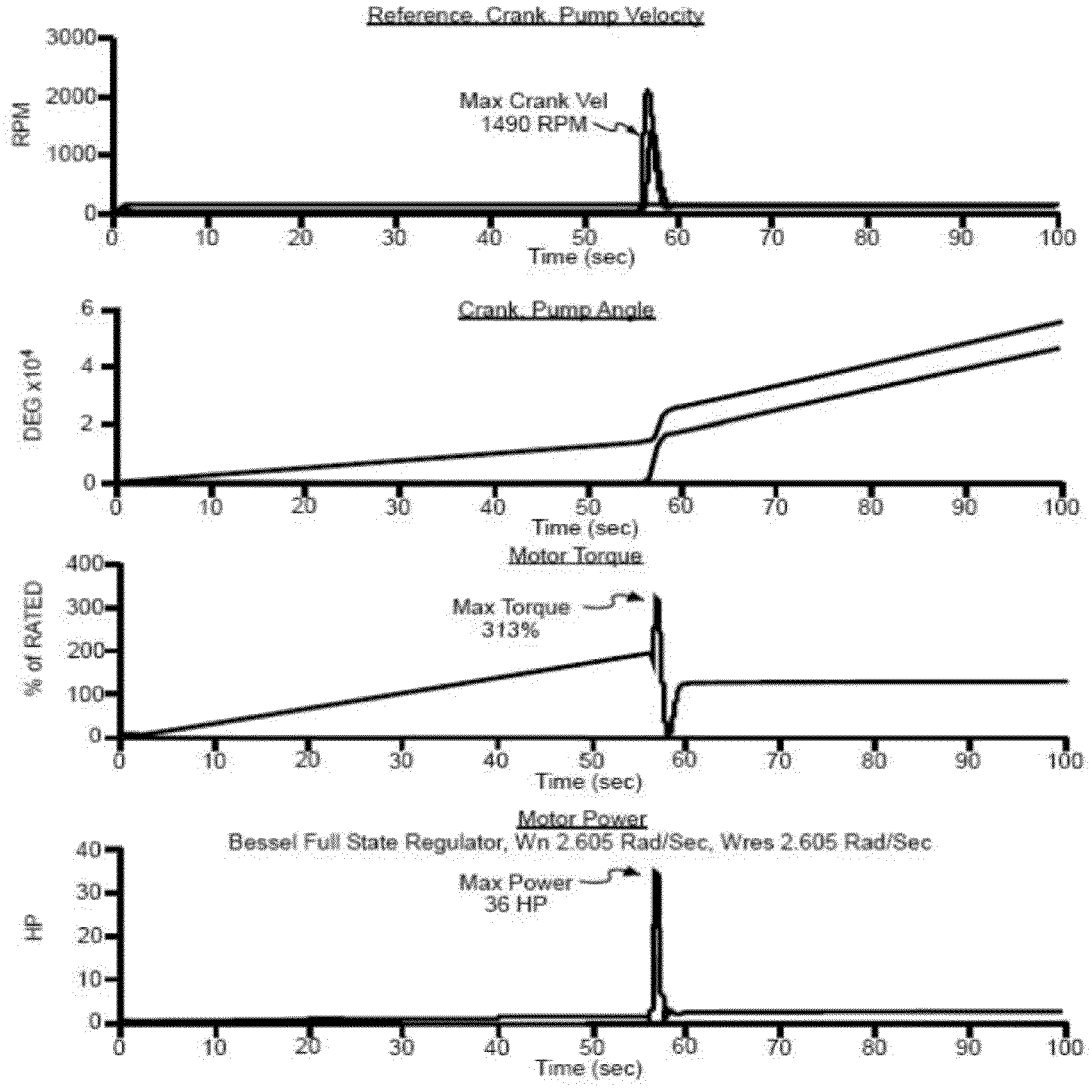
FIG. 12 is a series of graphs illustrating that a Bessel fuss state feedback regulator handles stick-slip.
Figure 13:
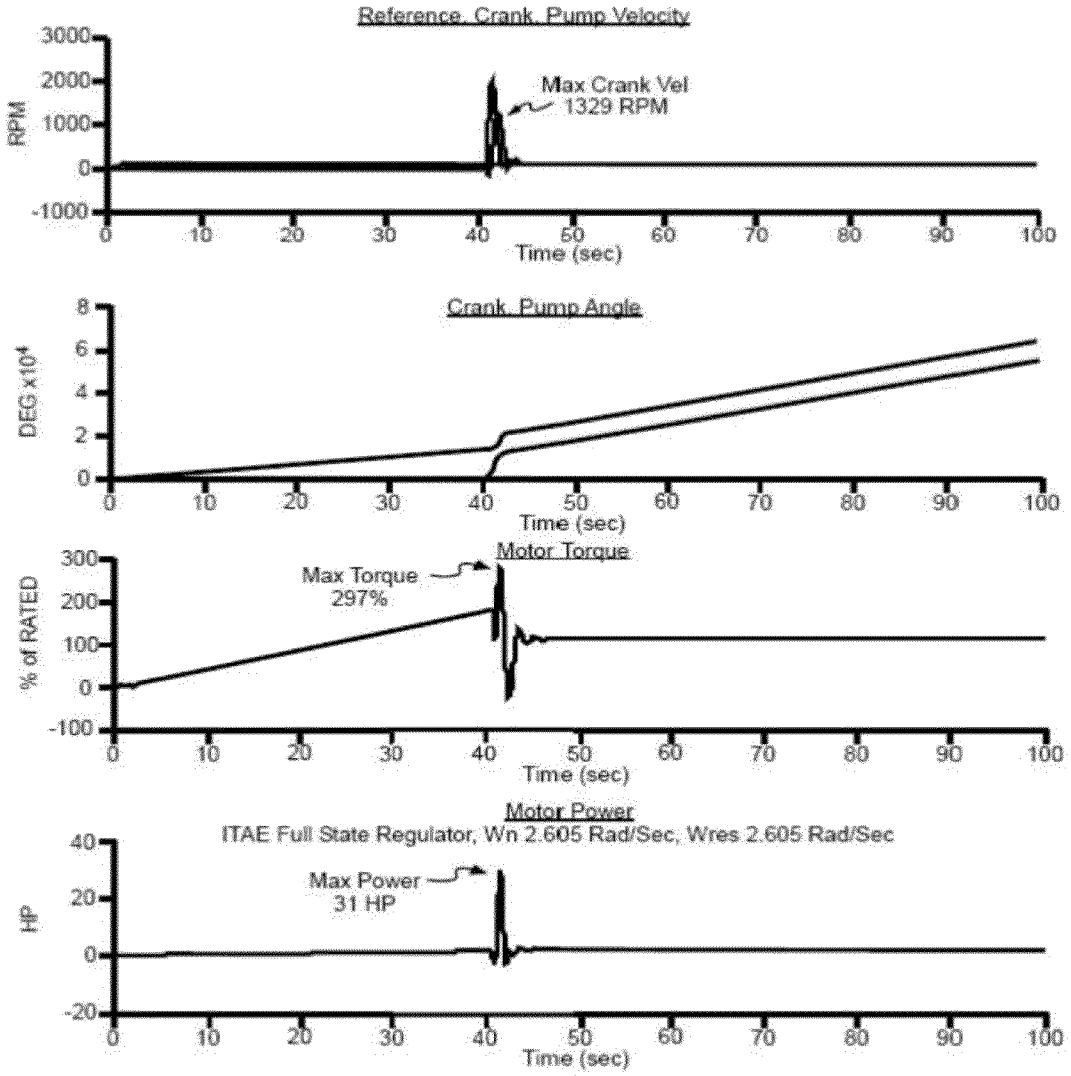
FIG. 13 is a series of graphs illustrating that an ITAE (integral of time multiplied by the absolute value of error) full state feedback regulator handles stick-slip.

Simulations were performed to analyze and determine which types of regulator schemes would work with respect to stick-slip. All regulation schemes were tuned for a natural frequency equivalent to the plant resonant frequency for consistency. FIG. 7 shows that a conventional PI (proportional integral) surface speed regulator does not handle the stick-slip load. As can be seen, the stick-slip condition is never averted. FIG. 8 shows that a linear quadratic regulator handles the stick-slip condition. FIG. 9 shows the same plot as FIG. 8 with the time scale expanded. FIG. 10 shows that a Butterworth full state feedback regulator does not handle stick-slip. FIG. 11 shows that a binomial full state feedback regulator handles stick-slip. FIG. 12 shows that a Bessel full state feedback regulator handles stick-slip. FIG. 13 shows that an ITAE (integral of time multiplied by the absolute value of error) full state feedback regulator handles stick-slip.

Table 1 below documents the simulated regulator results. Vmax refers to the maximum crank rpm encountered. Tmax refers to the maximum electrical torque. Pmax refers to the maximum instantaneous horsepower. These maximum values should be minimized to reduce drive sizing requirements.

TABLE 1

| Regulator | Successful at handling stick-slip? | Vmax | Tmax | Pmax |
|---|---|---|---|---|
| PI | No | — | — | — |
| Linear Quadratic Regulator | Yes | 1265 | 252 | 25 |
| Butterworth | NO | — | — | — |

TABLE 1-continued

| Regulator | Successful at handling stick-slip? | Vmax | Tmax | Pmax |
|---|---|---|---|---|
| Binomial | Yes | 1822 | 360 | 50 |
| Bessel | Yes | 1490 | 313 | 36 |
| ITAE | Yes | 1329 | 297 | 31 |

The simulation results show that the linear quadratic regulator exhibits the best stick-slip control response (i.e., minimized surface velocity, torque, and power). One of the drawbacks with the linear quadratic regulator is that tuning of the regulator is a manual weighting process which, while intuitive, is required to be done for each system. The next best alternative to the linear quadratic is the ITAE full state feedback regulator which has an analytic solution for the regulator gains.

Figure 14:
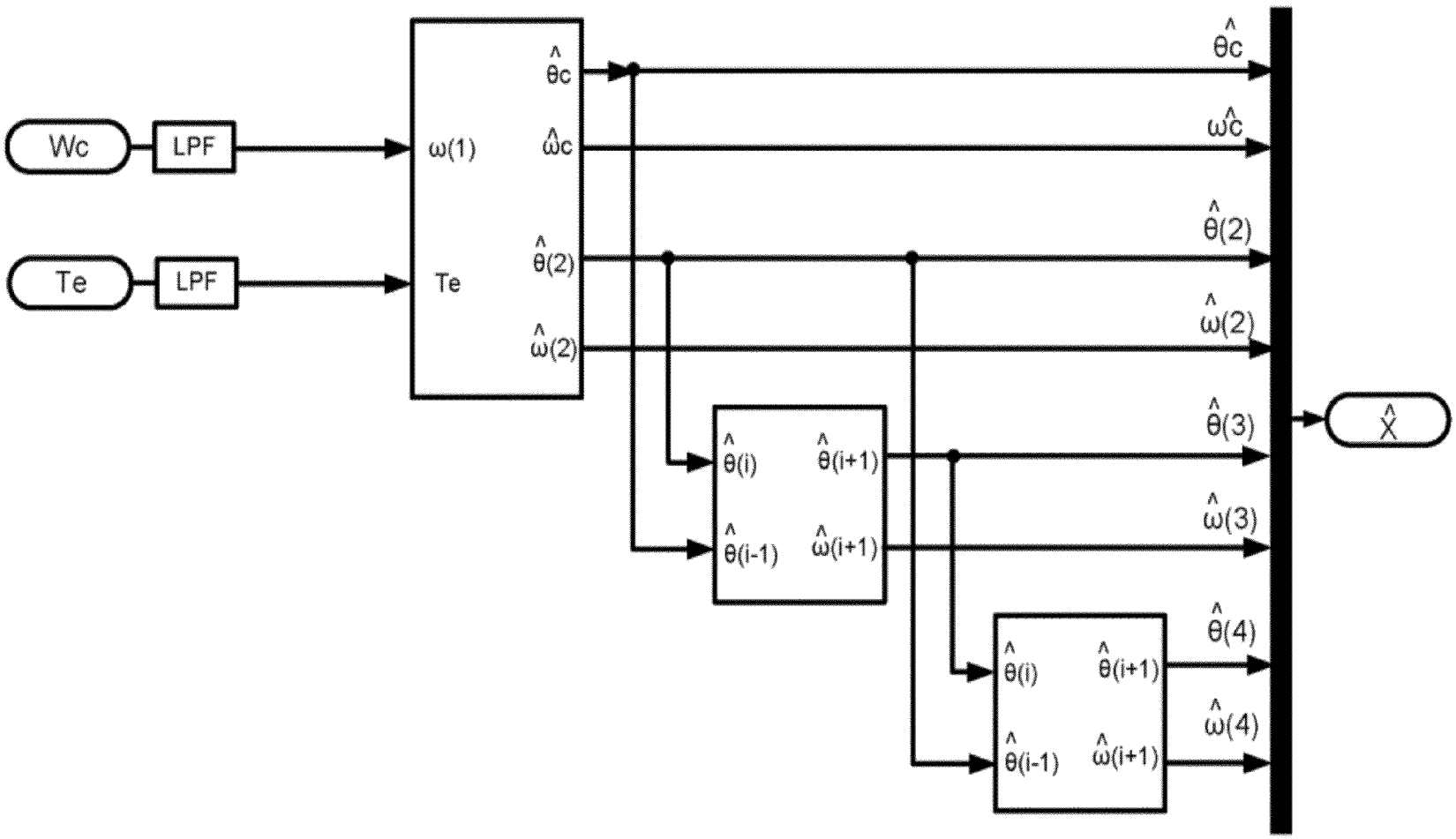
FIG. 14 is a block diagram of an example of a multi-section finite difference state estimate of a rotational rod.
Figure 15:
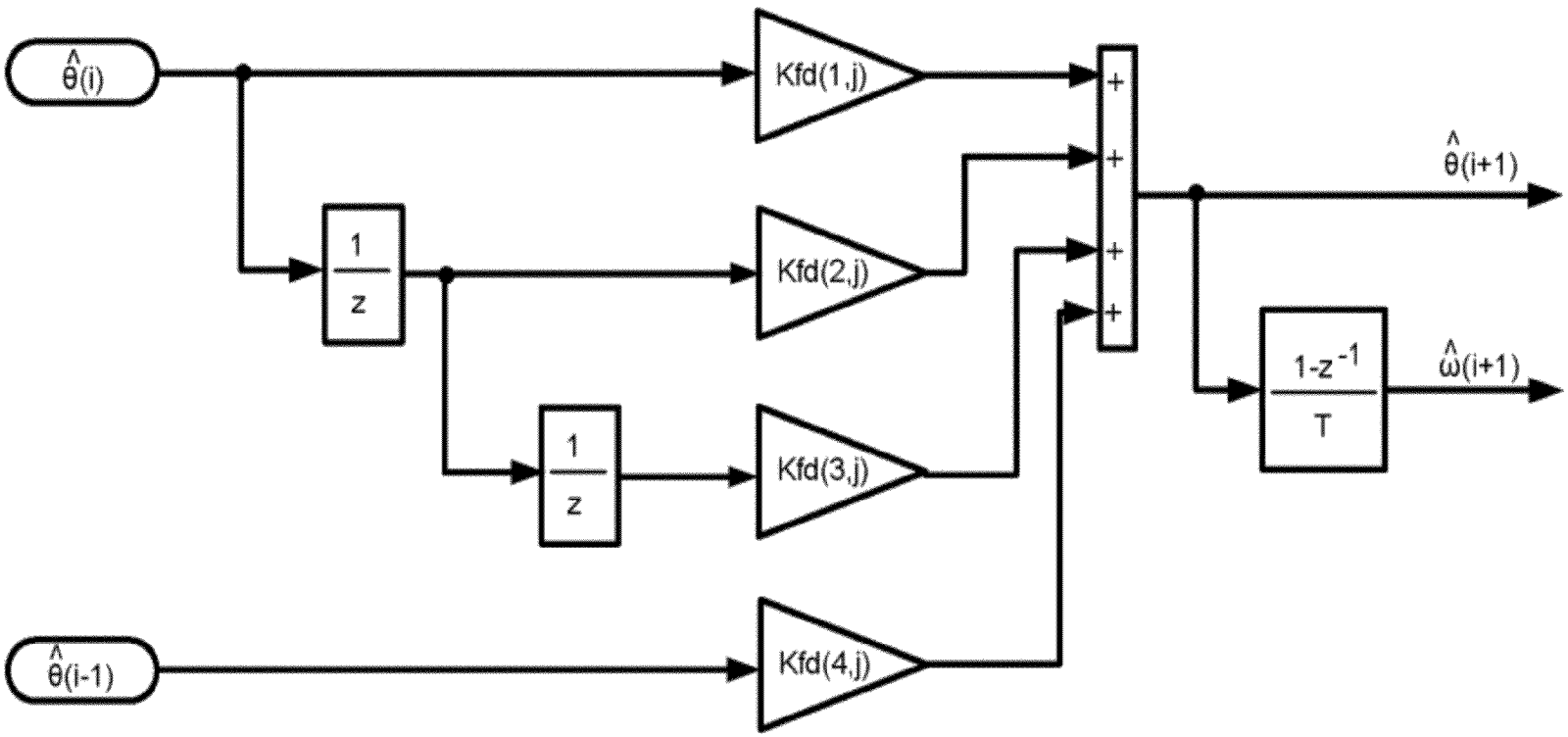
FIG. 15 is a block diagram of a j+1 node finite difference state estimate block of an example of a multi-section finite difference state estimate of the rotational rod of FIG. 14.

From the foregoing, it can be seen that a finite difference state estimator has been described that provides accurate real-time estimates of unmeasurable states. In the embodiments described, the unmeasurable states are down-hole pump states (e.g., pump speed and angle). While a single-section state estimator has been described, a multi-section finite difference state estimator can also be used where each node of the multi-section finite difference state estimator estimates the angle and speed of each section in the multi-section state estimator. An example of this would be in a pumping situation where there are multiple rod sections and the estimated speed and angle of each rod section is needed with higher precision than a single-section state estimator provides. An example of this would be the multi-spring finite difference state estimator shown in FIG. 14. The first stage estimator would be the same as the single-stage finite difference state estimator (see FIG. 4) with the output being intermediate acceleration a(2) and speed w(2) estimates. The remaining estimates of outputs are estimated with inputs of previous estimates and have gains indicated by Kfd(1,j) . . . KFD(4,j) where j is the j'th section gains. For the example shown in FIG. 14, the gains are:

$$Kfd(1,\ j) = -\left(-\frac{1}{T^2} - \frac{3}{2}\frac{Br*Nr}{T} - 2\frac{Vr}{dx^2}\right)*\frac{dx^2}{Vr^2} \text{ where}$$

$$dx = \frac{Xr}{Nr} \text{ (length/section)},$$

$$Vr = \text{velocity of sound in rod.}$$

$$Kfd(2,\ j) = -\left(\frac{2}{T^2} + 2\frac{br*Nr}{T}\right)*\frac{dx^2}{Vr^2}$$

$$Kfd(3,\ j) = -\left(-\frac{1}{T^2} - \frac{1}{2}\frac{br*Nr}{T}\right)*\frac{dx^2}{Vr^2}$$

$$Kfd(4,\ j) = -1$$

Making Kfd a 4×Nr matrix allows that gains to be varied along the rod length, which provides the capability to handle varying diameter rods.

While the invention is described herein in connection with certain preferred embodiments, there is no intent to limit it to those embodiments. On the contrary, the intent is to cover all alternatives, modifications and equivalents within the spirit and scope of the invention.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A tangible, non-transitory computer readable medium storing a set of instructions executable to control a system exhibiting stick-slip behavior and having unmeasurable states, the computer executable instructions, when executed, performing steps of:

receiving an electrical torque parameter, a crank angle parameter, and a crank speed parameter;

estimating the unmeasurable states;

sending estimates of the unmeasurable states to a regulator; and regulating the system to minimize differences between reference states and the estimates, wherein the regulator is one of a linear quadratic regulator, a binomial full state feedback regulator, a Bessel full state feedback regulator, and an ITAE ((integral of time multiplied by the absolute value of error) full state feedback regulator, and, wherein the system is a down-hole pump system and the unmeasurable states are pump angle and pump speed and the regulator has a gain [k1;k2;k3;k4] that corresponds to a gain for errors of a reference vector x* =[Ac*, Wc*, Ap*, Wp*] minus four system states $\hat{x}=[\hat{A}_c, \hat{W}_c, \hat{A}_p, \hat{W}_p]$ where Ac* is a crank angle command, Wc* is a crank speed command, Ap* is a pump angle command, Wp* is a pump speed command, $\hat{A}_c$ is a crank angle position, $\hat{W}_c$ is a crank speed, $\hat{A}_p$ is a pump angle estimate, and $\hat{W}_p$ is a pump speed estimate.

2. The computer readable medium of claim 1 wherein the step of estimating the unmeasurable states comprises the step of estimating the unmeasurable states with a finite difference state estimator.

3. The computer readable medium of claim 2, wherein the step of estimating the unmeasurable states with a finite difference state estimator comprises the steps of estimating the pump angle in accordance with the equation.

$$Ap(z) = Ac(z) - \frac{Ng}{Kr}\left(T_e(z) - \frac{b2+b}{Ng} * Wc(z) - \left(\frac{J2}{Ng * T}\right) * (Wc(z) - Wc(z-1))\right.$$

where T is the sampling period, Ac is the crank angle parameter, Te is the electrical torque parameter, We is the crank speed parameter, Ng is an estimate of gear reduction ratio, Kr is an estimate of rod spring stiffness constant, b2 is an estimate of drive damping, b is an estimate of the pump damping, J2 is an estimate of the inertia of the pump, and Ap is the estimated pump angle.

4. The computer readable medium of claim 3 wherein the step of estimating the unmeasurable states with a finite difference state estimator further comprises the steps of estimating the pump speed in accordance with the equation $$Wp = \frac{1}{T}(Ap(z) - Ap(z-1))$$

where Wp is the estimated pump speed.

5. The computer readable medium of claim 1 wherein the step of receiving an electrical torque parameter, a crank angle parameter, and a crank speed parameter comprises the steps of:

receiving a voltage measurement and a current measurement;

estimating the electrical torque parameter, the crank angle parameter, and the crank speed parameter based upon the voltage measurement and the current measurement.

6. The computer readable medium of claim 1 wherein the system has unmeasurable states in a plurality of sections connected to each other and the step of estimating the unmeasurable states comprises the step of estimating the unmeasurable states with a multi-section finite difference state estimator having a plurality of nodes, wherein each of the plurality of nodes estimates a angle and speed of each section in the multi-section state estimator.

7. The computer readable medium of claim 6 wherein the system having a plurality of rods connected to the pump, the computer readable medium having further computer executable instructions for performing the step of a first stage node in the plurality of nodes estimating an intermediate angle a(2) estimate and speed w(2) estimate based upon the electrical torque parameter, the crank angle parameter, and the crank speed parameter.

8. The computer readable medium of claim 7 wherein the computer readable medium having further computer executable instructions for performing the step of each of nodes estimating an angle and a speed of each section with inputs of previous estimates.

* * * * *